US010161346B2

(12) United States Patent
Ulrey et al.

(10) Patent No.: US 10,161,346 B2
(45) Date of Patent: Dec. 25, 2018

(54) ADJUSTING PUMP VOLUME COMMANDS FOR DIRECT INJECTION FUEL PUMPS

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 411 days.

(21) Appl. No.: 14/300,162

(22) Filed: Jun. 9, 2014

(65) Prior Publication Data

US 2015/0354491 A1 Dec. 10, 2015

(51) Int. Cl.

| | |
|---|---|
| ***F02B 3/00*** | (2006.01) |
| ***F02D 41/30*** | (2006.01) |
| ***F02M 63/00*** | (2006.01) |
| ***F02D 41/38*** | (2006.01) |
| ***F02M 59/10*** | (2006.01) |
| ***F02M 59/36*** | (2006.01) |

(Continued)

(52) U.S. Cl.

CPC ..... *F02D 41/3082* (2013.01); *F02D 41/123* (2013.01); *F02D 41/3845* (2013.01); *F02M 59/102* (2013.01); *F02M 59/368* (2013.01); *F02M 59/464* (2013.01); *F02M 63/0001* (2013.01); *F02D 2200/0602* (2013.01); *F02D 2200/0614* (2013.01); *F02M 59/462* (2013.01); *F02M 63/005* (2013.01)

(58) Field of Classification Search

USPC ..... 123/294

See application file for complete search history.

(56) References Cited

U.S. PATENT DOCUMENTS

| | | | |
|---|---|---|---|
| 6,209,525 | B1 | 4/2001 | Konishi et al. |
| 6,871,633 | B1 | 3/2005 | Date et al. |
| 6,953,025 | B2 | 10/2005 | Takahashi |

(Continued)

FOREIGN PATENT DOCUMENTS

| | | | |
|---|---|---|---|
| EP | 2647824 | A1 | 9/2013 |

OTHER PUBLICATIONS

Surnilla, Gopichandra et al., "Adaptive Learning of Duty Cycle for a High Pressure Fuel Pump," U.S. Appl. No. 14/099,615, filed Dec. 6, 2013, 44 pages.

(Continued)

*Primary Examiner* — Lindsay Low
*Assistant Examiner* — Ruben Picon-Feliciano
(74) *Attorney, Agent, or Firm* — Julia Voutyras; McCoy Russell LLP

(57) ABSTRACT

Methods are provided for controlling a direct injection fuel pump, wherein a solenoid spill valve is energized and de-energized according to certain conditions. A control strategy is needed to operate the direct injection fuel pump outside regions where pump operation may be variable and inaccurate, where the regions may be characterized by smaller pump commands as well as smaller displacement volumes. To maintain a suitable range of pump commands and displacements while operating outside the low accuracy regions, a method is proposed that involves clipping calculated pump commands when the calculated pump commands lie within the low accuracy regions.

20 Claims, 5 Drawing Sheets

(51) Int. Cl.
*F02D 41/12* (2006.01)
*F02M 59/46* (2006.01)

(56) References Cited

U.S. PATENT DOCUMENTS

| | | | | |
|---|---|---|---|---|
| 7,258,103 | B2 | 8/2007 | Tahara et al. | |
| 7,950,371 | B2 | 5/2011 | Cinpinski et al. | |
| 8,342,151 | B2 | 1/2013 | Gwidt et al. | |
| 2009/0090331 | A1 | 4/2009 | Pursifull | |
| 2011/0097228 | A1 | 4/2011 | Tokuo et al. | |
| 2012/0143475 | A1 | 6/2012 | Ryoo et al. | |
| 2012/0167859 | A1* | 7/2012 | Basmaji | F02D 19/0605 123/456 |
| 2012/0328452 | A1* | 12/2012 | Surnilla | F02M 37/0064 417/1 |
| 2013/0213359 | A1 | 8/2013 | Zeng et al. | |

OTHER PUBLICATIONS

Zhang, Hao et al., "Methods for Correcting Spill Valve Timing Error of A High Pressure Pump," U.S. Appl. No. 14/189,926, filed Feb. 25, 2014, 51 pages.
Pursifull, Ross D. et al., "Direct Injection Fuel Pump," U.S. Appl. No. 14/198,082, filed Mar. 5, 2014, 67 pages.
Pursifull, Ross D. et al., "Rapid Zero Flow Lubrication Methods for A High Pressure Pump," U.S. Appl. No. 14/231,451, filed Mar. 31, 2014, 54 pages.

* cited by examiner

ADJUSTING PUMP VOLUME COMMANDS FOR DIRECT INJECTION FUEL PUMPS

FIELD

The present application relates generally to a control scheme for a direct injection fuel pump of an internal combustion engine that involves clipping commands within regions to predetermined commands.

SUMMARY/BACKGROUND

Some vehicle engine systems utilizing direct in-cylinder injection of fuel include a fuel delivery system that has multiple fuel pumps for providing suitable fuel pressure to fuel injectors. This type of fuel system, Gasoline Direct Injection (GDI), is used to increase the power efficiency and range over which the fuel can be delivered to the cylinder. GDI fuel injectors may require high pressure fuel for injection to create enhanced atomization for more efficient combustion. As one example, a GDI system can utilize an electrically driven lower pressure pump (i.e., a fuel lift pump) and a mechanically driven higher pressure pump (i.e., a direct injection pump) arranged respectively in series between the fuel tank and the fuel injectors along a fuel passage. In many GDI applications the high-pressure or direct injection fuel pump may be used to increase the pressure of fuel delivered to the fuel injectors. The high-pressure fuel pump may include a solenoid actuated "spill valve" (SV) or fuel volume regulator (FVR) that may be actuated to control flow of fuel into the high-pressure fuel pump. Various control strategies exist for operating the higher and lower pressure pumps to ensure efficient fuel system and engine operation.

In one approach to control the direct injection fuel pump, shown by Cinpinski and Lee in U.S. Pat. No. 7,950,371, a diagnostic module controls a fuel pump module to operate a fuel pump that provides fuel to a fuel rail. The diagnostic module determines a predetermined amount of fuel to send to the fuel rail, determines an estimated pressure increase within the fuel rail based on the predetermined amount of fuel, and compares an actual pressure increase to an estimated pressure increase. Based on the comparison, the fuel pump control module selectively controls the fuel pump. In an example control scheme for operating the high pressure (direct injection) fuel pump, several steps are performed to compensate the fuel rail pressure in order to bring an actual rail pressure increase closer to an estimated rail pressure increase. Several steps involve measuring rail pressure and comparing that value to a threshold, upon which a commanded increase in pressure via operation of the fuel pump is monitored.

However, the inventors herein have identified potential issues with the approach of U.S. Pat. No. 7,950,371. First, while the control method of Cinpinski and Lee may provide control of the direct injection fuel pump to maintain operation near a desired threshold pressure, the method does not address several issues that may arise with lower pump displacement volumes. Lower pump displacement volumes may range from about 0% to 40% depending on the particular fuel system, wherein the percentage refers to the percentage of total pump displacement compressed and sent to the attached fuel rail. With lower displacement volumes, control of the direct injection pump (via the spill valve) may be inaccurate and variable. Therefore, the quantity of fuel pumped into the fuel rail may be unknown while commanding lower displacement volumes with low accuracy. As such, diagnostic and control functions may not be executed properly due to the variability in pump control.

Thus in one example, the above issues may be at least partially addressed by a method, comprising: when a calculated pump command of a direct injection fuel pump is between 0 and a zero flow lubrication command, issuing the zero flow lubrication command to a solenoid spill valve of the fuel pump; when the calculated pump command is between the zero flow lubrication command and a threshold command, issuing the threshold command; and when the calculated pump command is greater than the threshold command, issuing the calculated pump command. In this way, the direct injection pump is operated outside the regions where low accuracy and variable pump commands occur. Due to this, the pump may be only operated in regions and at commands where accurate and repeatable control is more likely to occur. Since fuel and engine systems vary between vehicles, the control method can be adjusted to learn what the zero flow lubrication and threshold commands are for a specific configuration. Issuing the zero flow lubrication command may accomplish the desired result of transferring no fuel into the fuel rail while creating a pressure difference across the pump piston which forces liquid into the piston-bore interface, thereby lubricating the piston-bore interface.

In another example, the issued direct injection pump commands depend on whether or not a measured fuel rail pressure is less than or greater than a desired fuel rail pressure. If the measured fuel rail pressure is less than the desired fuel rail pressure, then the issued pump commands are determined as described above. Alternatively, if the measured fuel rail pressure is greater than the desired fuel rail pressure, then the direct injection fuel pump is operated at the zero flow lubrication command. As explained in further detail later, the zero flow lubrication command may correspond to an energized time period of the solenoid spill valve that defines the boundary between 0 fuel volume pumped and a greater-than-0 fuel volume pumped. The pump commands cause specific pump trapping volumes to occur. Pump trapping volume, or displacement or pumped volume, is a measure of how much fuel is compressed and ejected to a fuel rail by the direct injection fuel pump.

In one example control strategy, the threshold command is chosen such that if the preliminary DI pump command is between the ZFL command and threshold command, the threshold command is issued. While this control strategy adds more fuel to the fuel rail than otherwise desired, the fuel pumped amount is increased to a less-variable level. As such, the control strategy effectively forms a minimum volume pumped into the fuel rail. Having a predictable fuel amount pumped may be beneficial for fuel rail pressure control and aid in vapor detection at the DI fuel pump inlet. Aiding in fuel vapor detection may result from the fuel pressure increase becoming measurable when it is sufficiently large, that is, by clipping the pump commands to the threshold command. As a percent-of-value, small pump volumes may be highly-variable, and therefore small pump volumes (i.e., pump stokes) may be undesirable.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
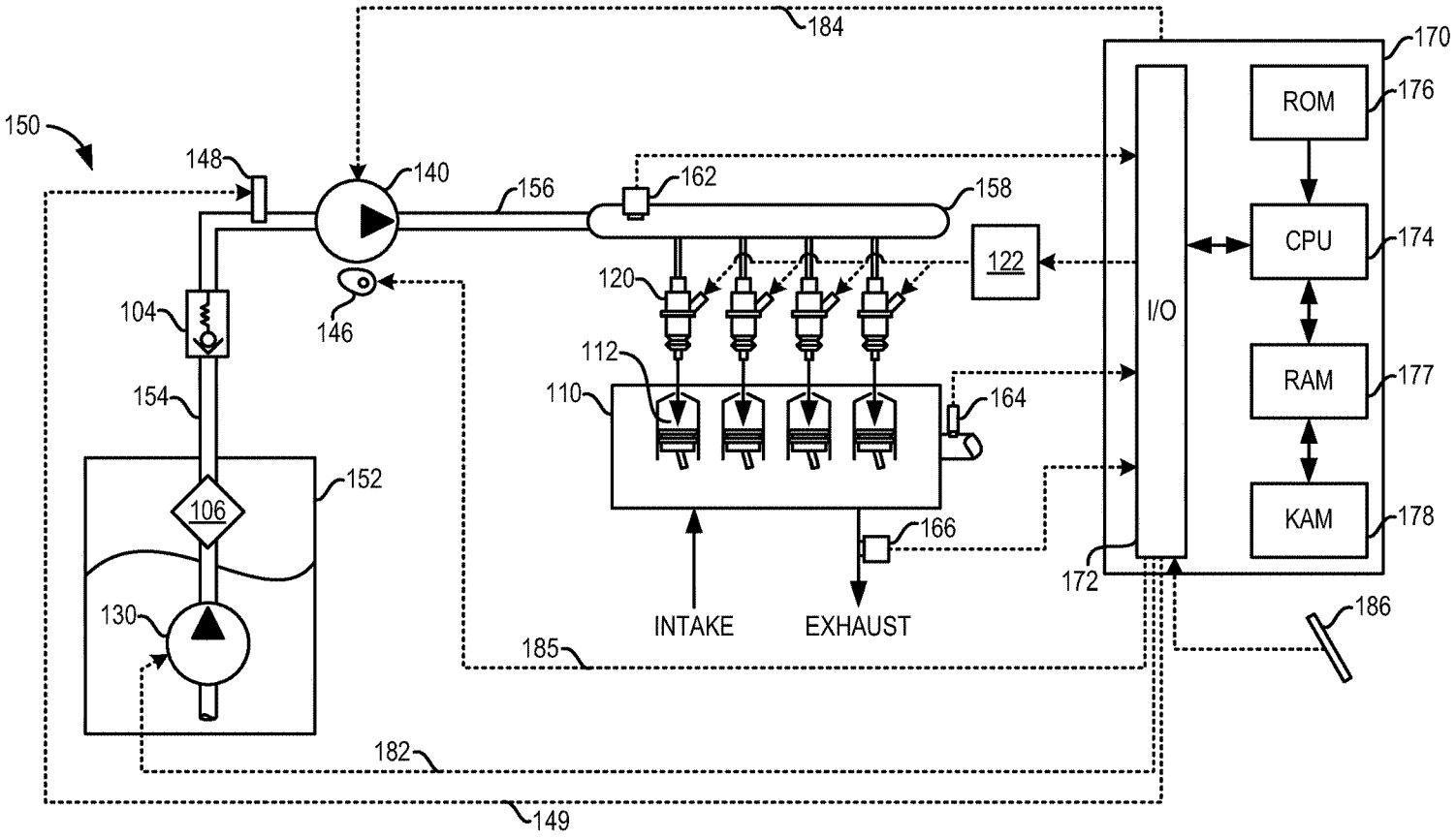
FIG. 1 shows a schematic diagram of an example fuel system coupled to an engine.
Figure 2:
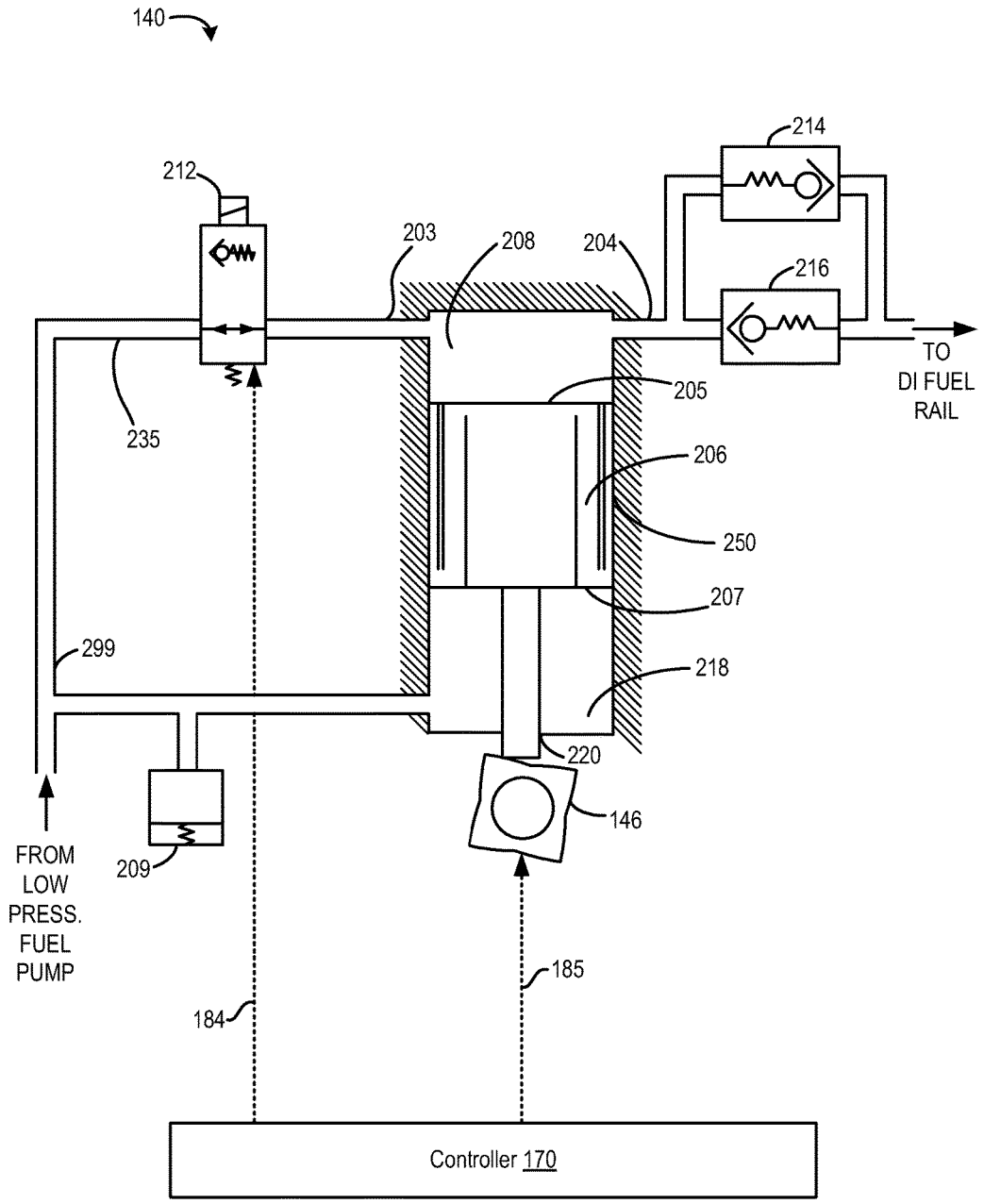
FIG. 2 shows a direct injection fuel pump and related components included in the fuel system of FIG. 1.
Figure 3:
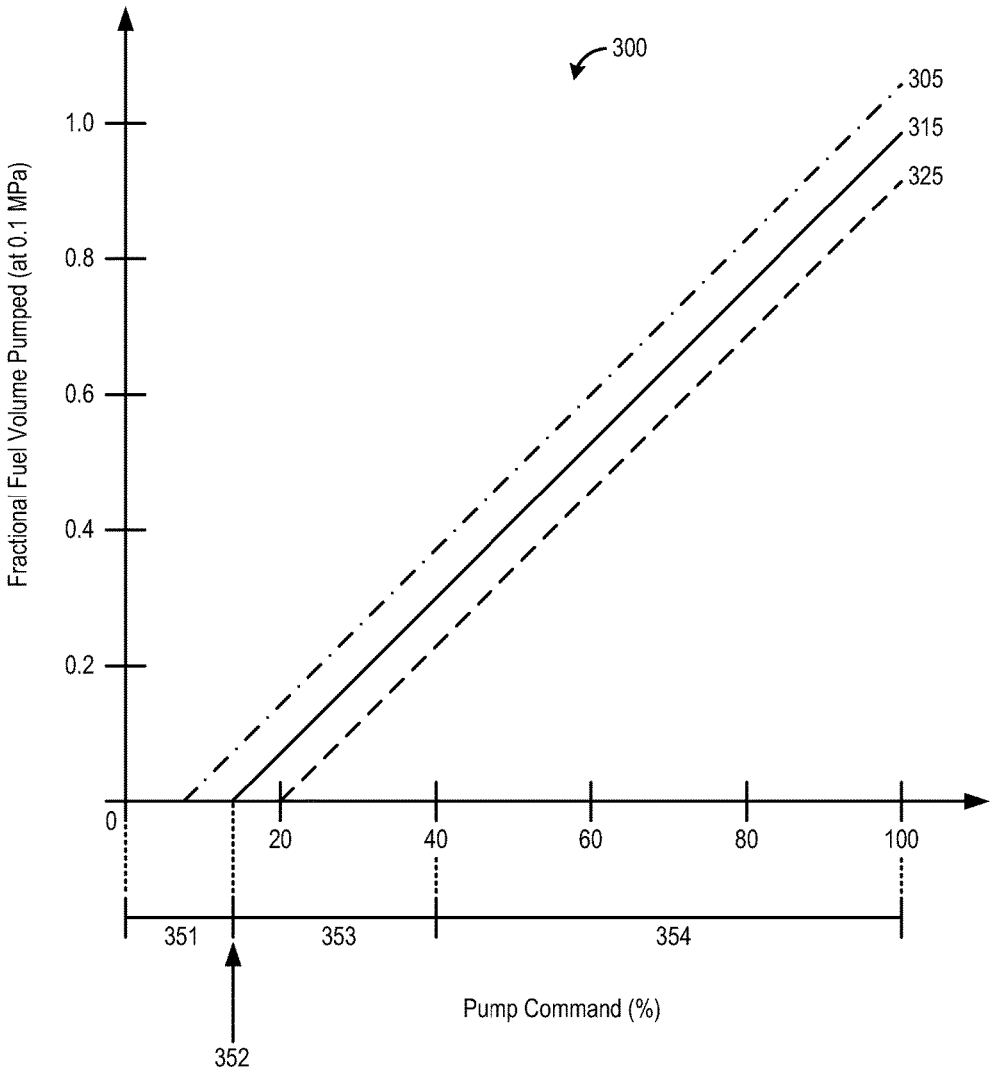
FIG. 3 shows a model of a direct injection fuel pump with several outlined regions and zero flow lubrication command.
Figure 4:
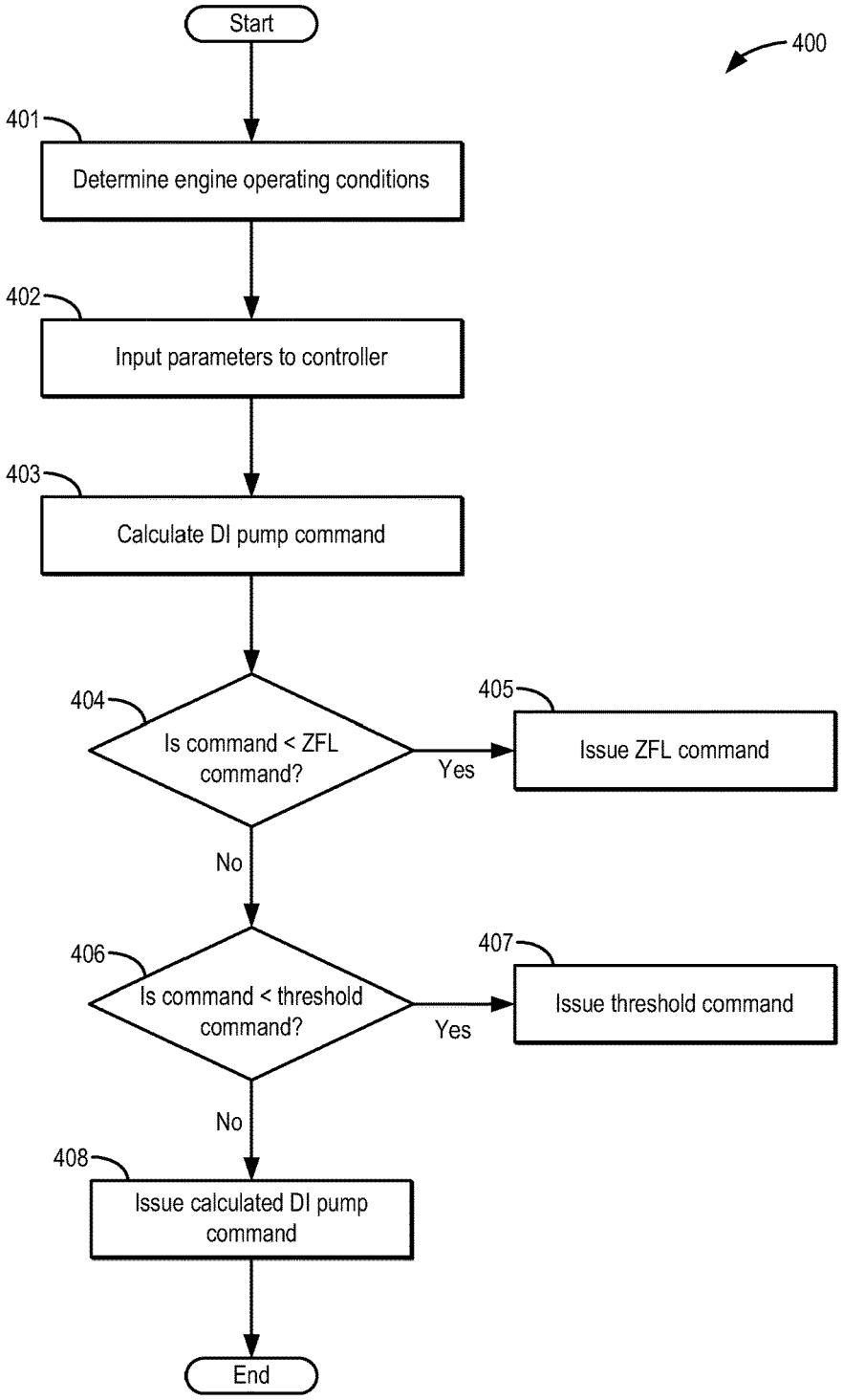
FIG. 4 shows a flow chart of a method for operating a direct injection fuel pump that involves clipping certain pump commands to predetermined commands.
Figure 5:
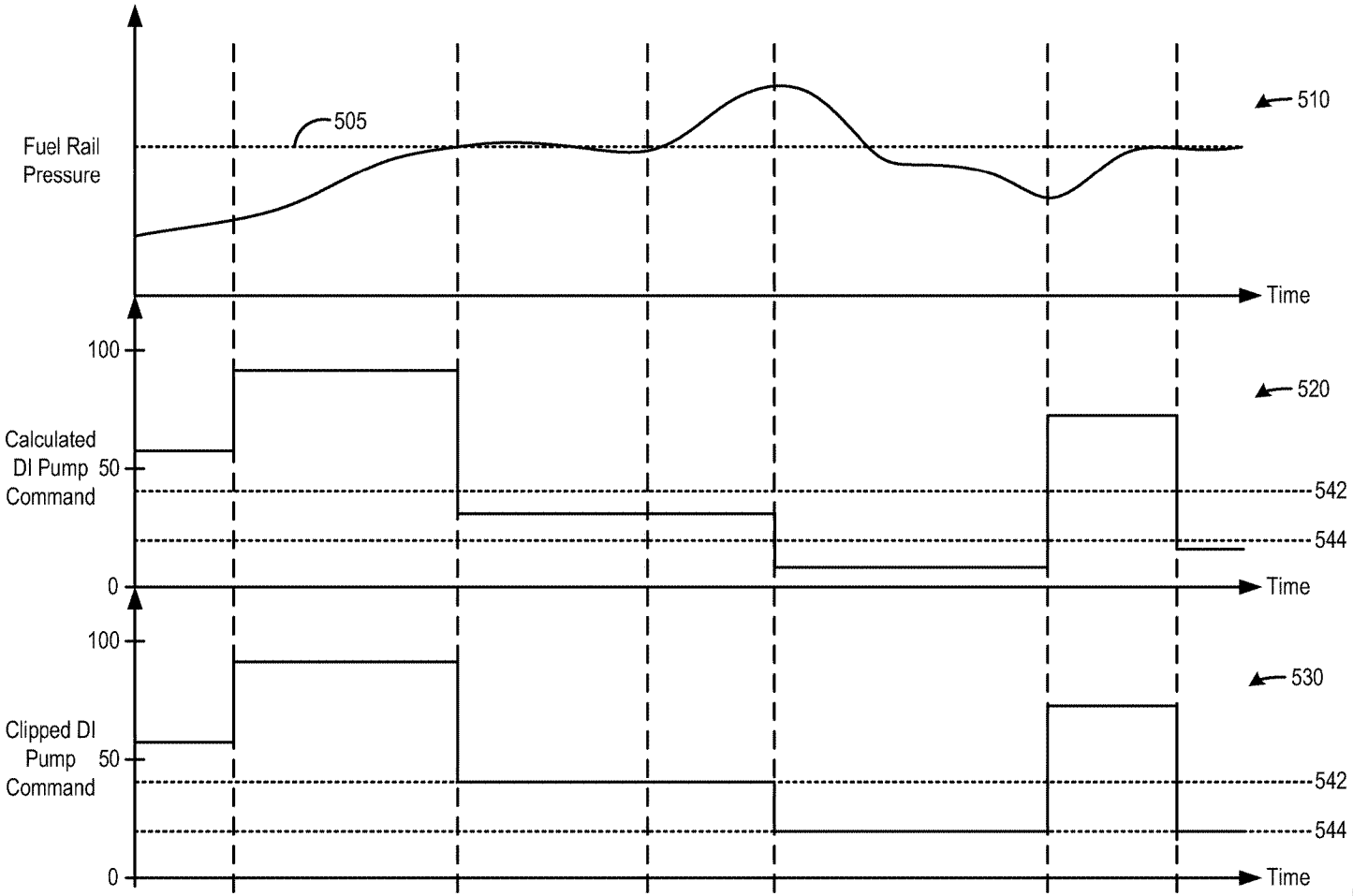
FIG. 5 shows a graphical representation of how fuel rail pressure fluctuates based on calculated and clipped pump commands according to the method of FIG. 4.

The following detailed description provides information regarding a direct injection fuel pump, its related fuel and engine systems, and a control strategy for regulating fuel volume and pressure provided by the direct injection fuel pump to the direct injection fuel rail and injectors. A schematic diagram of an example direct injection fuel system and engine is shown in FIG. 1 while FIG. 2 shows a detailed view of a direct injection fuel pump of FIG. 1 and associated components. FIG. 3 shows a graphical model of a direct injection fuel pump with several outlined features. FIG. 4 shows a flow chart that illustrates a method for operating a direct injection fuel pump while FIG. 5 shows a graphical representation of how the method of FIG. 4 affects fuel rail pressure during engine operation.

Regarding terminology used throughout this detailed description, a higher-pressure fuel pump, or direct injection fuel pump, that provides pressurized fuel to a direct injection fuel rail attached injectors may be abbreviated as a DI or HP pump. Similarly, a lower-pressure pump (compressing fuel at pressures generally lower than that of the DI pump), or lift pump, that provides pressurized fuel from a fuel tank to the DI pump may be abbreviated as an LP pump. Zero flow lubrication (ZFL) may refer to direct injection pump operation schemes that involve pumping substantially no fuel, thereby contributing a low amount of fuel pressure or no fuel pressure to the fuel rail pressure. A solenoid spill valve, which may be electronically energized to allow check valve operation and de-energized to open (or vice versa), may also be referred to as a fuel volume regulator, magnetic solenoid valve, and a digital inlet valve, among other names. Depending on when the spill valve is energized during operation of the DI pump, an amount of fuel may be trapped and compressed by the DI pump during a delivery stroke to send to the fuel rail and injectors. The amount of fuel compressed by the DI pump may be referred to as fractional trapping volume, fuel displacement volume, pump discharge volume, or pumped fuel mass, among other terms. The fractional trapping volume can be numerically expressed as a fraction, decimal, or percentage. While a pump command may be the desired fractional trapping volume, the actual fractional trapping volume may be different from the pump command.

FIG. 1 shows a direct injection fuel system 150 coupled to an internal combustion engine 110, which may be configured as a propulsion system for a vehicle. The internal combustion engine 110 may comprise multiple combustion chambers or cylinders 112. Fuel can be provided directly to the cylinders 112 via in-cylinder direct injectors 120. As indicated schematically in FIG. 1, the engine 110 can receive intake air and exhaust products of the combusted fuel. For simplicity, the intake and exhaust systems are not shown in FIG. 1. The engine 110 may include a suitable type of engine including a gasoline or diesel engine.

Fuel can be provided to the engine 110 via the injectors 120 by way of the direct injection fuel system indicated generally at 150. In this particular example, the fuel system 150 includes a fuel storage tank 152 for storing the fuel on-board the vehicle, a low-pressure fuel pump 130 (e.g., a fuel lift pump), a high-pressure fuel pump or direct injection (DI) pump 140, a fuel rail 158, and various fuel passages 154 and 156. In the example shown in FIG. 1, the fuel passage 154 carries fuel from the low-pressure pump 130 to the DI pump 140, and the fuel passage 156 carries fuel from the DI pump 140 to the fuel rail 158. Due to the locations of the fuel passages, passage 154 may be referred to as a low-pressure fuel passage while passage 156 may be referred to as a high-pressure fuel passage. As such, fuel in passage 156 may exhibit a higher pressure than fuel in passage 154. In some examples, fuel system 150 may include more than one fuel storage tank and additional passages, valves, and other devices for providing additional functionality to direct injection fuel system 150.

In the present example of FIG. 1, fuel rail 158 may distribute fuel to each of a plurality of direct fuel injectors 120. Each of the plurality of fuel injectors 120 may be positioned in a corresponding cylinder 112 of engine 110 such that during operation of fuel injectors 120 fuel is injected directly into each corresponding cylinder 112. Alternatively (or in addition), engine 110 may include fuel injectors positioned at or near the intake port of each cylinder such that during operation of the fuel injectors, fuel is injected with the charge air into the one or more intake ports of each cylinder. This configuration of injectors may be part of a port fuel injection system, which may be included in fuel system 150. In the illustrated embodiment, engine 110 includes four cylinders that are only fueled via direct injection. However, it will be appreciated that the engine may include a different number of cylinders.

The low-pressure fuel pump 130 can be operated by a controller 170 to provide fuel to DI pump 140 via fuel low-pressure passage 154. The low-pressure fuel pump 130 can be configured as what may be referred to as a fuel lift pump. As one example, low-pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power that is provided to LP pump 130, the volumetric flow rate and/or pressure increase across the pump may be reduced. Alternatively, the volumetric flow rate and/or pressure increase across the pump may be increased by increasing the electrical power that is provided to the pump 130. As one example, the electrical power supplied to the low-pressure pump motor can be obtained from an alternator or other energy storage device on-board the vehicle (not shown), whereby the control system provided by controller 170 can control the electrical load that is used to power the low-pressure pump. Thus, by varying the voltage and/or current provided to the low-pressure fuel pump 130, as indicated at 182, the flow rate and pressure of the fuel provided to DI pump 140 and ultimately to the fuel rail 158 may be adjusted by the controller 170.

Low-pressure fuel pump 130 may be fluidly coupled to filter 106 which may remove small impurities that may be contained in the fuel that could potentially damage fuel handling components. Filter 106 may be fluidly coupled to check valve 104 via low-pressure passage 154. Check valve 104 may facilitate fuel delivery and maintain fuel line pressure. In particular, check valve 104 includes a ball and spring mechanism that seats and seals at a specified pressure differential to deliver fuel downstream along low-pressure passage 154 to downstream components. In some embodiments, fuel system 150 may include a series of check valves fluidly coupled to low-pressure fuel pump 130 to further impede fuel from leaking back upstream of the valves. Next, fuel may be delivered from check valve 104 to high-pressure fuel pump (e.g., DI pump) 140. DI pump 140 may increase the pressure of fuel received from the check valve 104 from a first pressure level generated by low-pressure fuel pump 130 to a second pressure level higher than the first level. DI pump 140 may deliver high pressure fuel to fuel rail 158 via high-pressure fuel line 156. Operation of DI pump 140 may be adjusted based on operating conditions of the vehicle in order to provide more efficient fuel system and engine operation. The components and operation of the high-pressure DI pump 140 will be discussed in further detail below with reference to FIGS. 2-5.

The DI pump 140 can be controlled by the controller 170 to provide fuel to the fuel rail 158 via the high-pressure fuel passage 156. As one non-limiting example, DI pump 140 may utilize a flow control valve, a solenoid actuated "spill valve" (SV) or fuel volume regulator (FVR) to enable the control system to vary the effective pump volume of each pump stroke. The spill valve, described in more detail in FIG. 2, may be separate or part of (i.e., integrally formed with) DI pump 140. The DI pump 140 may be mechanically driven by the engine 110 in contrast to the motor driven low-pressure fuel pump or fuel lift pump 130. A pump piston of the DI pump 140 can receive a mechanical input from the engine crank shaft or cam shaft via a cam 146. In this manner, DI pump 140 can be operated according to the principle of a cam-driven, single-cylinder pump. Furthermore, the angular position of cam 146 may be estimated (i.e., determined) by a sensor located near cam 146 communicating with controller 170 via connection 185. In particular, the sensor may measure an angle of cam 146 measured in degrees ranging from 0 to 360 degrees according to the circular motion of cam 146. While cam 146 is shown outside of DI pump 140 in FIG. 1, it is understood that cam 146 may be included in the system of DI pump 140.

As depicted in FIG. 1, a fuel sensor 148 is disposed downstream of the fuel lift pump 130. The fuel sensor 148 may measure fuel composition and may operate based on fuel capacitance, or the number of moles of a dielectric fluid within its sensing volume. For example, an amount of ethanol (e.g., liquid ethanol) in the fuel may be determined (e.g., when a fuel alcohol blend is utilized) based on the capacitance of the fuel. The fuel sensor 148 may be connected to controller 170 via connection 149 and used to determine a level of vaporization of the fuel, as fuel vapor has a smaller number of moles within the sensing volume than liquid fuel. As such, fuel vaporization may be indicated when the fuel capacitance drops off. In some operating schemes, the fuel sensor 148 may be utilized to determine the level of fuel vaporization of the fuel such that the controller 170 may adjust the lift pump pressure in order to reduce fuel vaporization within the fuel lift pump 130. Although not shown in FIG. 1, a fuel pressure sensor may be located in low-pressure passage 154 between the lift pump 130 and the DI pump 140. In that location, the sensor may be referred to as the lift pump pressure sensor or the low-pressure sensor.

Further, in some examples, the DI pump 140 may be operated as the fuel sensor 148 to determine the level of fuel vaporization. For example, a piston-cylinder assembly of the DI pump 140 forms a fluid-filled capacitor. As such, the piston-cylinder assembly allows the DI pump 140 to be the capacitive element in the fuel composition sensor. In some examples, the piston-cylinder assembly of the DI pump 140 may be the hottest point in the system, such that fuel vapor forms there first. In such an example, the DI pump 140 may be utilized as the sensor for detecting fuel vaporization, as fuel vaporization may occur at the piston-cylinder assembly before it occurs anywhere else in the system. Other fuel sensor configurations may be possible while pertaining to the scope of the present disclosure.

As shown in FIG. 1, the fuel rail 158 includes a fuel rail pressure sensor 162 for providing an indication of fuel rail pressure to the controller 170. An engine speed sensor 164 can be used to provide an indication of engine speed to the controller 170. The indication of engine speed can be used to identify the speed of DI pump 140, since the pump 140 is mechanically driven by the engine 110, for example, via the crankshaft or camshaft. An exhaust gas sensor 166 can be used to provide an indication of exhaust gas composition to the controller 170. As one example, the gas sensor 166 may include a universal exhaust gas sensor (UEGO). The exhaust gas sensor 166 can be used as feedback by the controller 170 to adjust the amount of fuel that is delivered to the engine 110 via the injectors 120. In this way, the controller 170 can control the air/fuel ratio delivered to the engine to a prescribed set-point.

Furthermore, controller 170 may receive other engine/exhaust parameter signals from other engine sensors such as engine coolant temperature, engine speed, throttle position, absolute manifold pressure, emission control device temperature, etc. Further still, controller 170 may provide feedback control based on signals received from fuel sensor 148, pressure sensor 162, and engine speed sensor 164, among others. For example, controller 170 may send signals to adjust a current level, current ramp rate, pulse width of a solenoid valve (SV) of DI pump 140, and the like via connection 184 to adjust operation of DI pump 140. Also, controller 170 may send signals to adjust a fuel pressure set-point of the fuel pressure regulator and/or a fuel injection amount and/or timing based on signals from fuel sensor 148, pressure sensor 162, engine speed sensor 164, and the like. Other sensors not shown in FIG. 1 may be positioned around engine 110 and fuel system 150.

The controller 170 can individually actuate each of the injectors 120 via a fuel injection driver 122. The controller 170, the driver 122, and other suitable engine system controllers can comprise a control system. While the driver 122 is shown external to the controller 170, in other examples, the controller 170 can include the driver 122 or can be configured to provide the functionality of the driver 122. The controller 170, in this particular example, includes an electronic control unit comprising one or more of an input/output device 172, a central processing unit (CPU) 174, read-only memory (ROM) 176, random-accessible memory (RAM) 177, and keep-alive memory (KAM) 178. The storage medium ROM 176 can be programmed with computer readable data representing non-transitory instructions executable by the processor 174 for performing the methods described below as well as other variants that are anticipated but not specifically listed. For example, controller 170 may contain stored instructions for executing various control schemes of DI pump 140 and LP pump 130 based on several measured operating conditions from the aforementioned sensors.

As shown in FIG. 1, direct injection fuel system 150 is a returnless fuel system, and may be a mechanical returnless fuel system (MRFS) or an electronic returnless fuel system (ERFS). In the case of an MRFS, the fuel rail pressure may be controlled via a pressure regulator (not shown) positioned at the fuel tank 152. In an ERFS, a pressure sensor 162 may be mounted at the fuel rail 158 to measure the fuel rail pressure relative to the manifold pressure. The signal from the pressure sensor 162 may be fed back to the controller 170, which controls the driver 122, the driver 122 modulating the voltage to the DI pump 140 for supplying the correct pressure and fuel flow rate to the injectors.

Although not shown in FIG. 1, in other examples, direct injection fuel system 150 may include a return line whereby excess fuel from the engine is returned via a fuel pressure regulator to the fuel tank via a return line. The fuel pressure regulator may be coupled in-line with the return line to regulate fuel delivered to fuel rail 158 at a set-point pressure. To regulate the fuel pressure at the set-point, the fuel pressure regulator may return excess fuel to fuel tank 152 via the return line upon fuel rail pressure reaching the set-point. It will be appreciated that operation of the fuel pressure regulator may be adjusted to change the fuel pressure set-point to accommodate operating conditions.

FIG. 2 shows DI pump 140 of FIG. 1 in more detail. DI pump 140 intakes fuel from low-pressure passage 154 during an intake stroke and delivers the fuel to the engine via high-pressure passage 156 during a delivery stroke. DI pump 140 includes a compression chamber inlet 203 in fluidic communication with a compression chamber 208 that may be supplied fuel via low pressure fuel pump 130 as shown in FIG. 1. The fuel may be pressurized upon its passage through direct injection fuel pump 140 and supplied to fuel rail 158 (and direct injectors 120) through pump outlet 204. In the depicted example, direct injection pump 140 may be a mechanically-driven displacement pump that includes a pump piston 206 and piston rod 220, a pump compression chamber 208, and a step-room 218. A passage that connects step-room 218 to a pump inlet 299 may include an accumulator 209, wherein the passage allows fuel from the step-room 218 to re-enter the low pressure line surrounding inlet 299. Piston 206 also includes a top 205 and a bottom 207. The step-room 218 and compression chamber 208 may include cavities positioned on opposing sides of the pump piston. In one example, engine controller 170 may be configured to drive the piston 206 in direct injection pump 140 by driving cam 146. In one example, cam 146 includes four lobes and completes one rotation for every two engine crankshaft rotations.

DI pump inlet 299 allows fuel to spill valve 212 located along passage 235. Spill valve 212 is in fluidic communication with the low-pressure fuel pump 130 and high-pressure fuel pump 140. Piston 206 reciprocates up and down within compression chamber 208 according to intake and delivery/compression strokes. DI pump 140 is in a delivery/compression stroke when piston 206 is traveling in a direction that reduces the volume of compression chamber 208. Alternatively, DI pump 140 is in an intake/suction stroke when piston 206 is traveling in a direction that increases the volume of compression chamber 208. A forward flow outlet check valve 216 may be coupled downstream of an outlet 204 of the compression chamber 208. Outlet check valve 216 opens to allow fuel to flow from the compression chamber outlet 204 into the fuel rail 158 only when a pressure at the outlet of direct injection fuel pump 140 (e.g., a compression chamber outlet pressure) is higher than the fuel rail pressure. Operation of DI pump 140 may increase the pressure of fuel in compression chamber 208 and upon reaching a pressure set-point, fuel may flow through outlet valve 216 to fuel rail 158. A pressure relief valve 214 may be placed in parallel with check valve 216. Valve 214 may be biased to inhibit fuel from flowing downstream to fuel rail 158 but may allow fuel flow out of the DI fuel rail 158 toward pump outlet 204 when the fuel rail pressure is greater than a predetermined pressure (i.e., pressure setting of valve 214).

The solenoid spill valve 212 may be coupled to compression chamber inlet 203. As presented above, direct injection or high-pressure fuel pumps such as pump 140 may be piston pumps that are controlled to compress a fraction of their full displacement by varying closing timing of the solenoid spill valve. As such, a full range of pumping volume fractions may be provided to the direct injection fuel rail 158 and direct injectors 120 depending on when the spill valve 212 is energized and de-energized. In particular, controller 170 may send a pump signal that may be modulated to adjust the operating state (e.g., open or closed, check valve) of SV 212. Modulation of the pump signal may include adjusting a current level, current ramp rate, a pulse-width, a duty cycle, or another modulation parameter. Mentioned above, controller 170 may be configured to regulate fuel flow through spill valve 212 by energizing or de-energizing the solenoid (based on the solenoid valve configuration) in synchronism with the driving cam 146. Accordingly, solenoid spill valve 212 may be operated in two modes. In a first mode, solenoid spill valve 212 is not energized (deactivated or disabled) to an open position to allow fuel to travel upstream and downstream of a check valve contained in solenoid valve 212. During this mode, pumping of fuel into passage 156 cannot occur as fuel is pumped upstream through de-energized, open spill valve 212 instead of out of outlet check valve 216.

Alternatively, in the second mode, spill valve 212 is energized (activated) by controller 170 to a closed position such that fluidic communication across the valve is disrupted to limit (e.g., inhibit) the amount of fuel traveling upstream through the solenoid spill valve 212. In the second mode, spill valve 212 may act as a check valve which allows fuel to enter chamber 208 upon reaching the set pressure differential across valve 212 but substantially prevents fuel from flowing backward from chamber 208 into passage 235. Depending on the timing of the energizing and de-energizing of the spill valve 212, a given amount of pump displacement is used to push a given fuel volume into the fuel rail 158, thus allowing the spill valve 212 to function as a fuel volume regulator. As such, the timing of the solenoid valve 212 may control the effective pump displacement. Controller 170 of FIG. 1 is included in FIG. 2 for operating solenoid spill valve 212 via connection 184. Furthermore, connection 185 to measure the angular position of cam 146 is shown in FIG. 2. In some control schemes, angular position (i.e., timing) of cam 146 may be used to determine opening and closing timings of spill valve 212.

As such, solenoid spill valve 212 may be configured to regulate the mass (or volume) of fuel compressed into the direct injection fuel pump. In one example, controller 170 may adjust a closing timing of the solenoid spill valve to regulate the mass of fuel compressed. For example, a late spill valve 212 closing may reduce the amount of fuel mass ingested into the compression chamber 208. The solenoid spill valve opening and closing timings may be coordinated with respect to stroke timings of the direct injection fuel pump.

During conditions when direct injection fuel pump operation is not requested, controller 170 may activate and deactivate solenoid spill valve 212 to regulate fuel flow and pressure in compression chamber 208 to a single substantially constant pressure during most of the compression (delivery) stroke. Control of the DI pump 140 in this way may be included in zero flow lubrication (ZFL) methods. During such ZFL operation, on the intake stroke the pressure in compression chamber 208 drops to a pressure near the pressure of the lift pump 130. Subsequently, the pump pressure rises to a pressure near the fuel rail pressure at the end of the delivery (compression) stroke. If the compression chamber (pump) pressure remains below the fuel rail pressure, zero fuel flow results. When the compression chamber pressure is slightly below the fuel rail pressure, the ZFL operating point has been reached. In other words, the ZFL operating point is the highest compression chamber pressure that results in zero flow rate (i.e., substantially no fuel sent into fuel rail 158). Lubrication of DI pump 140 may occur when the pressure in compression chamber 208 exceeds the pressure in step-room 218. This difference in pressures may also contribute to pump lubrication when controller 170 deactivates solenoid spill valve 212. Deactivation of spill valve 212 may also reduce noise produced by valve 212. Said another way, even though the solenoid valve 212 is energized, if the outlet check valve 216 does not open, then the pump 140 may produce less noise than during other operating schemes. One result of this regulation method is that the fuel rail is regulated to a pressure depending on when solenoid spill valve is energized during the delivery stroke. Specifically, the fuel pressure in compression chamber 208 is regulated during the compression (delivery) stroke of direct injection fuel pump 140. Thus, during at least the compression stroke of direct injection fuel pump 140, lubrication is provided to the pump. When the DI pump enters a suction stroke, fuel pressure in the compression chamber may be reduced while still some level of lubrication may be provided as long as the pressure differential remains.

As an example, a zero flow lubrication strategy may be commanded when direct fuel injection is not desired (i.e., requested by the controller 170). When direct injection ceases, pressure in the fuel rail 158 is desired to remain at a near-constant level. As such, the spill valve 212 may be deactivated to the open position to allow fuel to freely enter and exit the pump compression chamber 208 so fuel is not pumped into the fuel rail 158. An always-deactivated spill valve corresponds to a 0% trapping volume, that is, 0 trapped volume or 0 displacement. As such, lubrication and cooling of the DI pump may be reduced while no fuel is being compressed, thereby leading to pump degradation. Therefore, according to ZFL methods, it may be beneficial to energize the spill valve 212 to pump a small amount of fuel when direct injection is not requested. As such, operation of the DI pump 140 may be adjusted to maintain a pressure at the outlet of the DI pump at or below the fuel rail pressure of the direct injection fuel rail, 158 thereby forcing fuel past the piston-bore interface of the DI pump. By maintaining the outlet pressure of the DI pump just below the fuel rail pressure and without allowing fuel to flow out of the outlet of the DI pump into the fuel rail, the DI pump may be kept lubricated, thereby reducing pump degradation. This general operation may be referred to as zero flow lubrication (ZFL).

It is noted here that DI pump 140 of FIG. 2 is presented as an illustrative, simplified example of one possible configuration for a DI pump. Components shown in FIG. 2 may be removed and/or changed while additional components not presently shown may be added to pump 140 while still maintaining the ability to deliver high-pressure fuel to a direct injection fuel rail. Furthermore, the methods presented hereafter may be applied to various configurations of pump 140 along with various configurations fuel system 150 of FIG. 1. In particular, the zero flow lubrication methods described above may be implemented in various configurations of DI pump 140 without adversely affecting normal operation of the pump 140.

Gasoline direct injection pumps, such as pump 140, are commonly positive displacement pumps with variable displacement as controlled by a solenoid valve, such as SV 212. The main purpose of such pumps is to provide a variable, controlled fuel pressure to the fuel rail. For many fuel and engine systems, it may be beneficial to pump a known quantity of fuel into the fuel rail for a high quality fuel rail pressure control. When the fuel pumped into the fuel rail is of an accuracy higher than those of other systems, several functions may be enabled. These functions may include allowing reduced current to the solenoid valve to reduce ticking noise generated by the high-pressure pump. Another function may include more accurate fuel vapor detection at the inlet of the high-pressure pump, which may be beneficial to timely detect and alleviate problems associated with vapor formation. Finally, more accurate pump control may allow the bulk modulus of the fuel to be detected (i.e., measured), a parameter that is useful for monitoring fuel and engine system performance.

The inventors herein have recognized that for small commanded pumping volumes, that is, energizing the SV 212 near the top-dead-center position of piston 206 to compress a small amount of fuel to send to fuel rail 158, the pumped fuel mass may be relatively inaccurate. In other words, for a single small pump command such as 9%, the amount of fuel sent to fuel rail 158 may significantly vary between subsequent pumping cycles of the DI pump 140. This variability between pumped volumes for small commands reduces the accuracy of the DI pump, which may not allow the aforementioned desired functionalities to occur.

As an example to illustrate how small pumping volumes are undesirable, a pump command is issued to pump 2% of the full pumping volume. Thus, the controller 170 commands the ZFL amount (e.g., 8%) plus the 2% command for a sum of 10%. However, since the DI pump commands may have a ±4% of full pump volume variability, the actual amount of pumped fuel volume may be 2%±4% of full pump volume. Quantitatively, the uncertainty is at worst a 200 percent-of-value error. Alternatively, if a 40% minimum volume is requested, then the actual volume pumped is 40%±4% of full volume. Quantitatively, the uncertainty is at worst a 10 percent-of-value error. It is noted that to execute the 40% volume request, the issued command is 40%+8% ZFL=48% actual command taking into account the ZFL operating point. The ZFL value is an offset between the desired percent of full volume and the actual commanded volume. In this way, it can be seen that smaller pump commands may be undesirable due to possible higher inaccuracies compared to the lower inaccuracies of larger pump commands (relative to the smaller pump commands).

As the pump command increases, such as above 20%, the fuel mass delivery becomes more accurate and repeatable relative to the expected amount of fuel delivery (as a percent-of-value). In this context, repeatability of the DI pump 140 may refer to pumping substantially the same fuel mass on subsequent pump cycles while maintaining substantially the same pump command. It is noted that the higher or lower accuracies are relative to each other. The inventors herein have recognized that the general trend is that accuracy increases as the pump command increases (from 0%-100%).

FIG. 3 shows a graph 300 of operation of the DI pump 140 as the pump command is varied. Graph 300 may be a model of DI pump 140, wherein one or more equations and variables may be used to create the lines shown in graph 300. The horizontal axis is the DI pump command, which may also be known as commanded duty cycle, commanded fractional liquid fuel volume pumped, or commanded trapping volume. The term trapping volume refers to the amount of fuel that is trapped inside compression chamber 208 when SV 212 is closed (energized), wherein the trapped fuel volume is compressed by piston 206 and sent to the fuel rail 158. The values of the horizontal axis are represented as percentages, but they can be equivalently shown as fractions ranging from 0 to 1 instead. The vertical axis of graph 300 is the actual fractional volume of fuel pumped or the measured fractional amount of fuel compressed by DI pump 140 and sent to the fuel rail 158. The values of the vertical axis range from 0 to 1 since the fractional pumped volume is shown in graph 300. Alternatively, the actual pumped volume (not fractional) can be shown along the vertical axis, wherein the units may be cubic centimeters ($cm^3$) and the maximum value of 1 is replaced with 0.25 $cm^3$, the full displacement volume of a typical DI pump. As seen in FIG. 3, multiple lines are present on graph 300, wherein each line corresponds to a fuel rail pressure. Ideally, a linear relationship would exist between the commanded fractional volume pumped and actual fractional volume pumped, represented by a line passing through the origin. However, due to various factors, not as much fuel is pumped as is commanded. In the present example, line 305 may correspond to a fuel rail pressure (FRP) of 2 MPa while line 315 may correspond to an FRP of 7 MPa and line 325 may correspond to an FRP of 12 MPa. Other lines may be included in graph 300, but for the sake of simplicity, only three lines are shown.

Based on testing and measured variability between pumped volumes of successive pump cycles, several qualitative zones may be established to distinguish where relatively most and least accurate DI pump control is present. Several of these zones are presented on graph 300 which correspond to line 315, where FRP 7 MPa. It is understood that the accuracy zones may vary depending on various factors such as the FRP and particular fuel and engine systems. The relatively most accurate pump operation may occur in a high accuracy region 354, where the pump commands range from about 40% to 100% for this particular example. The highest accuracy may occur when the pump command is 100%, which is otherwise known as full delivery strokes. A low accuracy region 353 is located to the left of high accuracy region 354, wherein pump commands of the low accuracy region 353 may range from about 17% to 40%. In this region, more fuel volume variability may occur as compared to the variability of the high accuracy region 354.

The leftmost zone, called a zero flow region 351, is characterized by issuing a pump command but no fuel is pumped into the fuel rail 158. In this example, the zero flow region 351 may correspond to pump commands ranging from 0% to about 17%, wherein line 315 lies along the horizontal axis. When issuing zero flow lubrication pump commands as previously mentioned, it is desirable to maintain a pressure at the outlet 204 of the DI pump 140 at or below the fuel rail pressure of the DI fuel rail 158, thereby forcing fuel past the piston-bore interface of the DI pump 140 to lubricate the pump. The pump command that may achieve this result may occur at the command when any increase in command would cause an increase in pumped volume from 0 to a measurable amount. In the current example of line 315 corresponding to an FRP of 7 MPa, this event may occur at point 352, or the zero flow lubrication command 352. In this example, point 352 corresponds to a 17% pump command (desired displacement volume), wherein the transition from the zero flow region 351 and low accuracy region 353 occurs. Physically, point 352 is where an increase in pump command causes a non-zero pumped fuel volume to occur. From graph 300, it can be seen that FRP and DI pump control is most accurate when larger, not smaller pumping volumes are commanded. Commanding in this sense may refer to energizing timing of SV 212 as controlled by controller 170 via connection 184, for example.

For controlling the DI fuel pump 140 via activation of SV 212, controller 170 may contain a fuel rail pressure module. The module may determine a desired FRP from a calculation based on parameters such as fuel injector requirements and engine demand. As such, inputs to the FRP module may include a desired FRP, an actual FRP, and current fuel injection rate. In some examples, the desired FRP is based on engine demand and fuel injector performance as determined by controller 170. The actual FRP may be a measured quantity from FRP sensor 162 while the current fuel injection rate may be received from the fuel injection driver 122. From these inputs, a commanded DI pump volume may be computed and sent to SV 212. In an example DI pump operation scheme, throughout a given DI pump cycle, based on an amount of fuel injected by injectors 120, the controller 170 or other suitable controller commands a certain pump volume. Next, the controller determines if the actual FRP is higher or lower than the desired FRP. Based on the comparison, a fuel volume may be added to or subtracted from the DI pump command. As such, two fuel volumes are added or subtracted, being the volume needed to keep the injectors 120 supplied with fuel and FRP nearly-constant, and the volume needed to increase or decrease the FRP.

The inventors herein have proposed a DI pump control method that involves clipping (i.e., modifying) the DI pump commands in order to ensure better control over the variability of small commands. In other words, upon calculation of several variables as described below, pump commands may be issued that operate the DI pump 140 outside the low accuracy region 353 and zero flow region 351 of FIG. 3. Furthermore, depending on the variables, the proposed control method may still allow for a range of commands that correspond to a range of pump displacement volumes. As such, the zone of variable and inaccurate pump pulses or commands may be avoided. In this way, various diagnostic and detection methods of controller 170 can be better executed by utilizing the resulting repeatable and accurate DI pumping volumes. The proposed method involves inputting calculated DI pump commands and outputting modified commands based on a number of variables, as explained in further detail below.

FIG. 4 shows an example control method 400 for operating a direct injection fuel pump, such as pump 140 of FIG. 1. Control method 400, as mentioned above, may be included in controller 170 as an executable series of computer-readable instructions for inputting and outputting various variables and/or commands. In this context, DI pump commands are implemented as the angular timing of electrical power provided to solenoid valve 212 via connection 184. For example, a 100% DI pump command has the inlet check valve 212 enabled by a bottom-dead-center position of piston 206 while a 50% command has the inlet check valve enabled half-way between the bottom-dead-center and a top-dead-center positions of the piston. Throughout the description of control method 400, reference will be made to FIG. 3 and the graphical representation of DI pump command versus fuel rail pressure.

First, at 401, the method includes determining a number of engine operating conditions. These conditions may vary depending on the engine and fuel system configurations, and may include, for example, engine speed, desired FRP, actual FRP, fuel composition and temperature, engine fuel demand, driver demanded torque, a threshold DI pump command, a ZFL command, and engine temperature. The ZFL command, as explained with regard to FIG. 3, may be predetermined based on the specific fuel and engine systems. For example, the current ZFL command could be 17%. The threshold command may be defined as the command between the low accuracy zone 353 and high accuracy zone 354 of FIG. 3. For example, as seen in FIG. 3, the threshold command (desired displacement volume) may be 40%. Next, at 402, the controller 170 receives a number of input parameters. As outlined above, the input parameters (i.e., variables) may include a desired FRP, actual FRP, current injection rate, and current pumped fuel volume. From these parameters and/or other parameters, at 403, the method includes calculating the DI pump command. For example, if the current pumped fuel volume is known at a given time during the DI pump cycle, then the current pumped fuel volume is set to be the same as a first pump displacement volume. Furthermore, if the actual FRP is lower than the desired FRP, then a second displacement volume is added to the first pump displacement volume. The controller 170 may have a series of calibration tables that correlate fuel rail pressure responses to a series of pump displacement volumes. As such, the second displacement volume may be chosen based on the difference between the actual and desired fuel rail pressures. With the first and second volumes, a calculated displacement volume can be determined. Finally, the calculated displacement volume can be converted to a calculated DI pump command. Since the DI pump command is expressed as a percentage or fraction of the total displacement of the DI pump, the correlation between calculated volume and command may vary depending on the size of the pump and the displacement volume. The calculated DI pump command may vary between 0% and 100%.

Next, at 404, the method includes determining if the calculated DI pump command is less than the ZFL command. This step involves determining if the calculated DI pump command lies in the zero flow region, such as zero flow region 351 of FIG. 3. If the calculated DI pump command is less than the ZFL command, then at 405 the method includes issuing the ZFL command. As such, any calculated DI pump command that is below the ZFL command is clipped up to the ZFL command, which may be a relatively smaller displacement such as 17% as shown in FIG. 3. Alternatively, if the calculated DI pump command is larger than the ZFL command, then at 406 the method includes determining if the calculated DI pump command is below the threshold command. Since the threshold command is larger than the ZFL command, such as 40% in FIG. 3, the method at 406 determines if the calculated DI pump command lies in the low accuracy region, such as low accuracy region 353 of FIG. 3. If the calculated DI pump command is less than the threshold command, then at 407 the method includes issuing the threshold command. As such, any calculated DI pump command that is in between the ZFL and threshold commands is clipped up to the threshold command. Alternatively, if the calculated DI pump command is larger than the threshold command, then at 408 the method includes issuing the calculated DI pump command that was calculated in step 403. As such, any calculated DI pump command that lies in the high accuracy region, such as high accuracy region 354 of FIG. 3, is not clipped and the calculated DI pump command is issued. In this context, issuing the pump command may refer to sending the appropriate electronic signal to energize solenoid valve 212.

As an example, using the regions and values of FIG. 3, any calculated pump command ranging from 0% to 17% (zero flow region 351) is increased to equal the ZFL command 352, which is defined by the point at which any further command increase would result in a responsive pumped fuel volume. Furthermore, any calculated pump command ranging from 17% to the threshold command of 40% (low accuracy region 353) is increased to equal the threshold command. The threshold command may be defined as the qualitative point at which any larger pump command is accurate and repeatable. Finally, any calculated pump command ranging from 40% to 100% (high accuracy region 354) remains unchanged and the calculated pump command is issued to the solenoid valve 212. As seen, method 400 increases the calculated DI pump command to certain values (ZFL and threshold commands) when the calculated commands are low and in the low accuracy region that is characterized by inaccurate and highly variable pump commands. In some cases, the threshold command may be set to higher values such as 100%.

In another example, method 400 may be executed when a measured fuel rail pressure is less than a desired fuel rail pressure. During such a condition method 400 may be executed, which includes operating the direct injection fuel pump at the zero flow lubrication command when the calculated pump command of the DI pump is between 0% and the ZFL command greater than 0%. Alternatively, the DI pump is operated at the threshold command when the calculated pump command is between the zero flow lubrication command and a greater, threshold command. Alternatively, the DI pump fuel pump is operated at the calculated pump command when the calculated pump command is between the threshold command and 100%. When the measured fuel rail pressure is greater than the desired fuel rail pressure, then the DI fuel pump may be operated at the ZFL command, thereby utilizing only step 405 of method 400.

FIG. 5 shows several graphs of DI pump variables as they change based on each other throughout a period of time. Graph 510 shows fuel rail pressure along the vertical axis as it changes throughout time, which is shown along the horizontal axis. As seen, the fuel rail pressure may fluctuate depending on various factors such as engine demand and how often the direct injectors 120 are operating. Graph 520 shows the calculated DI pump command along the vertical axis at it changes throughout time, also shown along the horizontal axis. Lastly, graph 530 shows the clipped DI pump command along the vertical axis as it changes throughout time, also shown along the horizontal axis. The calculated and clipped DI pump commands are the same as those terms described with regard to method 400 of FIG. 4. FIG. 5 is a graphical representation of method 400, repeated several times during operation of the DI pump 140. It is noted that the shapes of graphs 510, 520, and 530 are understood to be exemplary in nature and may be different depending on the specific fuel and engine systems.

Referring to FIG. 5, fuel rail pressure 505 may be the desired fuel rail pressure during the time period between times t1 and t6. The desired FRP may depend on various operating conditions and change throughout engine operation, but in the present example the desired FRP remains constant from time t1 to time t6. Furthermore, the threshold command 542 is shown as a horizontal line across graphs 520 and 530. The ZFL command 544 is also shown as a second horizontal line across graphs 520 and 530, where the ZFL command 544 is less than the threshold command 542. For example, the threshold command 542 may be 40% while the ZFL command may be 17%. It is noted that while numerical values are given below for ease of understanding, it is understood that any specific values may be used while still pertaining to method 400 and its graphical representation shown in FIG. 5. Furthermore, while commands 542 and 544 defining the transitions between the low accuracy, ZFL, and high accuracy zones for a specific FRP are shown as horizontal lines, they may fluctuate with the changing FRP. However, for the sake of simplicity, it is assumed that the range of fluctuating fuel rail pressures shown in graph 510 correspond to about the same threshold command 542 and ZFL command 544. In reality, the commands change slightly depending on FRP as seen in FIG. 3.

The graphs of FIG. 5 show an example of how the FRP, calculated, and clipped DI pump commands change throughout a period of time. Initially, FRP 510 is below the desired FRP 505 as seen between times t0 and t1. The sensors located in the fuel and engine systems, such as sensor 162, may detect the pressure in fuel rail 158. Upon detecting the lower-than-desired pressure, the controller 170 may issue an elevated calculated DI pump command, which corresponds to energizing solenoid valve 212 earlier during the delivery stroke than the previous DI pump command present from time t0 to t1. Since the elevated pump command shown between times t1 and t2 is above the threshold command 542, the clipped DI pump command is identical to the calculated DI pump command. It is noted that the calculated DI pump command may be determined then clipped, and the clipped command is issued to solenoid valve 212. From time t1 to t2, in response to the elevated pump command, the FRP increases until it reaches the desired FRP 505 at time t2. To maintain the desired FRP 505 while fuel volume is being injected into the cylinders 112 from fuel rail 158, the calculated pump command is lowered to a value such as 30%, lower than the threshold command 542 (40%). As such, according to method 400, the command is clipped to equal the threshold command of 40% as seen in FIG. 5 between times t2 and t3.

Next, at time t3, the fuel rail pressure may again start to increase beyond the desired FRP 505. The FRP may increase for a number of reasons, including reduced engine demand such that a lower injection rate is requested, thereby allowing more pressure to build-up in the fuel rail 158. As such, between times t3 and t4 the fuel rail pressure may increase. During this time, the issued (clipped) pump command remains at the same threshold command. At time t4, in response to the fuel rail pressure exceeding an upper threshold or other similar safety control, controller 170 may calculate a low DI pump command, such as 5%. As seen in the low accuracy region 353 of FIG. 3, a low pump command such as 5% may in reality result in no pumped volume. No pumped volume is desired in this situation since pumping more fuel into rail 158 may undesirably increase the fuel rail pressure. According to method 400, the calculated command of 5% (or other value) is clipped to the ZFL command 544 (17%). While providing lubrication to the piston-bore interface of the DI pump, the ZFL command also does not pump fuel into the fuel rail 158, thereby achieving the goal of a 0 displacement volume. From time t4 to t5, in response to the 0 displacement volume and upon continued direct injection, the fuel rail pressure may decrease below the desired FRP 505. Upon detection of the fuel rail pressure falling below a lower threshold, controller 170 may calculate an increased DI pump command such as 75%. Since 75% is above the threshold command 542 (40%), then the clipped command is also 75%. From times t5 to t6, the increased pump command is held at 75% until the fuel rail pressure reaches the desired FRP 505. Subsequently, to maintain the desired FRP, controller 170 may calculate a command of 15%, which is then clipped to ZFL command 544 (17%). As such, zero flow lubrication may occur while pumping no fuel into the fuel rail 158.

In summary, the control method 400 (graphically shown in FIG. 5) involves operating the DI pump 140 outside the smaller pump commands while still allowing the pump to achieve a large range of displacements from the threshold command to 100% which correspond to a large range of pumped fuel volumes to the fuel rail 158. In this way, the regions of inaccurate and variable pumping volumes are avoided, thereby allowing controller 170 to perform additional diagnostics and functions that depend on accurate pumping volumes. For example, with accurate pumping volumes, vapor detection at the inlet 299 of the DI pump 140 can be made more effective. The vapor detection method may include noting the fuel amount that is commanded to enter the fuel rail and comparing that value with the actual rise in FRP. Pumping inaccuracy may be present if small fuel amounts are commanded and there may also be inaccuracy when small pressure increases are measured. Therefore, larger pumping commands may enable robust fuel vapor detection because both the actual amount of fuel entering the fuel rail is metered with greater accuracy and the fuel pressure rise is measured with greater accuracy. In this example, accuracy may refer to percent-of-value rather than percent-of-full-scale. In another example, accurate detection of the bulk modulus of the fuel depends on accurate pump commands. While enabling these functions, the control method 400 also allows for effective fuel rail pressure control that may be of the same quality as other DI pump control methods.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

in response to a determination that a calculated pump command is between 0 and a zero-flow lubrication command, operating a solenoid spill valve of a direct injection fuel pump with the zero-flow lubrication command;

in response to a determination that the calculated pump command is between the zero-flow lubrication command and a threshold command, operating the solenoid spill valve with the threshold command; and in response to a determination that the calculated pump command is greater than the threshold command, operating the solenoid spill valve with the calculated pump command, the method including:

operating with the calculated pump command between 0 and the zero-flow lubrication command, operating with the calculated pump command between the zero-flow lubrication command and the threshold command, and operating with the calculated pump command greater than the threshold command.

2. The method of claim 1, wherein the threshold command and zero-flow lubrication command correspond to displacement volumes of fuel pumped into a direct injection fuel rail by the direct injection fuel pump during a delivery stroke, and further comprising calculating the calculated pump command based on a desired fuel rail pressure and a measured fuel rail pressure.

3. The method of claim 2, wherein the displacement volumes are controlled by an activating timing of the solenoid spill valve fluidically coupled upstream of a compression chamber inlet of the direct injection fuel pump, and wherein the desired fuel rail pressure is based on engine demand and fuel injector performance.

4. The method of claim 1, wherein operating the solenoid spill valve with the zero-flow lubrication command includes maintaining an elevated pressure in a compression chamber of the direct injection fuel pump without increasing fuel rail pressure, and wherein while operating the solenoid spill valve with the threshold command, fuel is delivered by the direct injection fuel pump into a direct injection fuel rail coupled to an outlet of the direct injection fuel pump.

5. The method of claim 4, wherein the elevated pressure forces fuel past a piston-bore interface of the direct injection fuel pump to lubricate and cool the direct injection fuel pump, and wherein the threshold command is based on a boundary between lower accuracy pump commands and higher accuracy pump commands.

6. The method of claim 4, wherein while operating the solenoid spill valve with the zero-flow lubrication command, no fuel is pumped by the direct injection fuel pump into the direct injection fuel rail.

7. The method of claim 2, wherein operating the solenoid spill valve with the calculated pump command includes commanding displacement volumes of the direct injection fuel pump based on the desired fuel rail pressure, the measured fuel rail pressure, and a fuel injection volume rate, wherein a displacement volume corresponding to the zero-flow lubrication command is less than a displacement volume corresponding to the threshold command, and wherein the displacement volume corresponding to the threshold command is less than a displacement volume corresponding to the calculated pump command.

8. The method of claim 1, further comprising operating the solenoid spill valve with the zero-flow lubrication command when a measured fuel rail pressure is greater than a desired fuel rail pressure, the desired fuel rail pressure based on calculations from a controller that issues commands to the solenoid spill valve, and wherein operating the solenoid spill valve includes sending an electric signal corresponding to the zero-flow lubrication command, the threshold command, or the calculated pump command to the solenoid spill valve, the electric signal energizing the solenoid spill valve at a pump displacement corresponding to the command, wherein the energizing closes the solenoid spill valve.

9. A method, comprising:

when a measured fuel rail pressure is less than a desired fuel rail pressure:

calculating a pump command of a direct injection fuel pump based on the measured fuel rail pressure and the desired fuel rail pressure;

in response to the calculated pump command being between 0% and a zero-flow lubrication command greater than 0%, operating the direct injection fuel pump at the zero-flow lubrication command;

in response to the calculated pump command being between the zero-flow lubrication command and a greater, threshold command, operating the direct injection fuel pump at the threshold command; and in response to the calculated pump command being between the threshold command and 100%, operating the direct injection fuel pump at the calculated pump command; and when the measured fuel rail pressure is greater than the desired fuel rail pressure, operating the direct injection fuel pump at the zero-flow lubrication command; the method including:

operating with the measured fuel rail pressure less than the desired fuel rail pressure and the calculated pump command between 0% and the zero-flow lubrication command greater than 0%, the calculated pump command between the zero-flow lubrication command and the greater, threshold command, and the calculated pump command between the threshold command and 100%, and operating with the measured fuel rail pressure greater than the desired fuel rail pressure.

10. The method of claim 9, wherein the desired fuel rail pressure is based on engine demand and fuel injector performance as determined by a controller, and wherein operating the direct injection fuel pump includes closing a solenoid spill valve by energizing the solenoid spill valve with an electrical signal.

11. The method of claim 9, wherein the measured fuel rail pressure is measured by a pressure sensor positioned in a direct injection fuel rail that is fluidically coupled to an outlet of the direct injection fuel pump, and wherein the threshold command is based on a boundary between lower accuracy pump commands and higher accuracy pump commands.

12. The method of claim 9, wherein operating at the zero-flow lubrication command includes maintaining an elevated pressure in a compression chamber of the direct injection fuel pump without substantially affecting fuel rail pressure, wherein the zero-flow lubrication command corresponds to a first displacement volume of the direct injection fuel pump and the threshold command corresponds to a second displacement volume of the direct injection fuel pump.

13. The method of claim 12, wherein the elevated pressure forces fuel past a piston-bore interface of the direct injection fuel pump to lubricate and cool the direct injection fuel pump, and wherein the first displacement volume is less than the second displacement volume.

14. The method of claim 13, wherein while operating at the zero-flow lubrication command, substantially no fuel is pumped by the direct injection fuel pump into a direct injection fuel rail coupled to an outlet of the direct injection fuel pump, wherein the calculated pump command corresponds to a third displacement volume of the direct injection fuel pump, wherein the second displacement volume is less than the third displacement volume, and wherein while operating the solenoid spill valve with the threshold command, fuel is delivered by the direct injection fuel pump into the direct injection fuel rail.

15. A fuel system, comprising:

a direct injection fuel pump fluidically coupled upstream of a direct injection fuel rail with a plurality of injectors, the direct injection fuel pump including a solenoid spill valve positioned at an inlet of the direct injection fuel pump, wherein the solenoid spill valve is activated and deactivated between closed and open positions, respectively;

a lift pump fluidically coupled upstream of the direct injection fuel pump, the lift pump providing fuel to the inlet of the direct injection fuel pump; and a controller, with computer-readable instructions stored in non-transitory memory for:

clipping a calculated pump command to a first threshold command when the calculated pump command is within a first region and clipping the calculated pump command to a second threshold command when the calculated pump command is within a second region;

wherein the first threshold command corresponds to a first displacement volume of the direct injection fuel pump, wherein the second threshold command corresponds to a second displacement volume of the direct injection fuel pump, and wherein the first displacement volume is less than the second displacement volume.

16. The system of claim 15, wherein the first region ranges from 0 to the first threshold command and the second region ranges from the first threshold command to the second threshold command, and wherein the controller includes further instructions for: when the calculated pump command is within the first or second region, issuing the clipped calculated pump command to the direct injection fuel pump, and when the calculated pump command is not within the first or second region, issuing the calculated pump command to the direct injection fuel pump.

17. The system of claim 16, wherein the first threshold command is a zero-flow lubrication command and the second threshold command is based on a boundary between lower accuracy pump commands and higher accuracy pump commands, and wherein the controller includes further instructions for calculating the calculated pump command based on a desired fuel rail pressure and a measured fuel rail pressure.

18. The system of claim 16, wherein clipping the calculated pump command when the calculated pump command is in the first or second region operates displacement volumes of the direct injection fuel pump outside the first and second regions, wherein issuing the clipped calculated pump command comprises energizing the solenoid spill valve to close the solenoid spill valve at an angular timing corresponding to the clipped calculated pump command, and wherein while issuing the second threshold command to the solenoid spill valve, fuel is delivered by the direct injection fuel pump into the direct injection fuel rail.

19. The system of claim 15, wherein the closed position of the solenoid spill valve includes substantially inhibiting fuel from flowing upstream from a compression chamber of the direct injection fuel pump towards the lift pump.

20. The system of claim 15, wherein the open position of the solenoid spill valve includes allowing fuel to flow upstream and downstream through the solenoid spill valve, and wherein compressed fuel in a compression chamber of the direct injection fuel pump flows upstream through the solenoid spill valve.

* * * * *